United States Patent [19]

Huang et al.

[11] Patent Number: 4,935,252

[45] Date of Patent: Jun. 19, 1990

[54] MICROWAVE OVEN PREPARATION OF WAFFLE

[75] Inventors: Hua-Feng Huang, Mendenhall, Pa.; Frederick E. Simon, Lindenwold, N.J.

[73] Assignees: E. I. Du Pont de Nemours and Company, Wilmington, Del.; Campbell Soup Company, Camden, N.J.

[21] Appl. No.: 220,051

[22] Filed: Jun. 2, 1988

[51] Int. Cl.[5] ..... B65B 25/22

[52] U.S. Cl. ..... 426/107; 426/109; 426/113; 426/393; 426/394

[58] Field of Search ..... 426/107, 109, 113, 114, 426/393, 394

[56] References Cited

U.S. PATENT DOCUMENTS 3,983,256 9/1976 Norris et al. ..... 426/94
4,190,757 2/1980 Turpin et al. ..... 219/10.55 E
4,230,924 10/1980 Brastad et al. ..... 219/10.55 E
4,626,641 12/1986 Brown ..... 426/107
4,656,325 4/1987 Keefer ..... 219/10.55 E
4,676,857 6/1987 Scharr et al. ..... 156/233

FOREIGN PATENT DOCUMENTS 0242952 10/1987 European Pat. Off. .

*Primary Examiner*—Donald E. Czaja

[57] ABSTRACT

A package for cooking a waffle in a microwave oven is provided, comprising a microwave transparent tray about 28 to 38 mm deep, a lossy susceptor film lid having defined reflectance and absorbance, placed about 3 to about 10 mm over the waffle, providing means for moisture to escape. The waffle is coated with an edible food conditioner, to provide improved microwave susceptibility to the surfaces of the waffle. The waffle may be cooked alone or in the presence of a sausage side dish.

16 Claims, 2 Drawing Sheets

MICROWAVE OVEN PREPARATION OF WAFFLE

FIELD OF THE INVENTION

This invention relates to the field of microwave cooking and particularly to the field of partially cooked, frozen foodstuffs such as waffles and to materials and packages useful in that field.

Microwave ovens have experienced an enormous growth of acceptance among the public because of their speed, convenience, and energy efficiency. This has created a parallel interest among convenience food packagers to extend the number of products which may be successfully prepared in such ovens. To accomplish this goal, packagers must find ways to overcome the deficiencies characteristic of propagating and non-propagating microwave energy modes which can produce adverse effects with some foodstuffs. One group of problems arises from standing waves set up by complete reflections from the oven walls, the packaging, and the foodstuff itself. Another group of problems results from the large differences in the microwave heating susceptibility among various foodstuffs.

In applications involving the cooking or reheating of dense, wet, or liquid foods, these differences are not too troublesome. Serious problems are encountered, however, in achieving acceptable results on foods that require surface browning and crisping. Foodstuffs such as waffles which are packaged frozen and only partially cooked are particularly difficult to prepare in a microwave oven because of their low density and high transmissivity of the microwave energy. When the waffle is exposed to sufficient microwave energy to brown the surface, the depth of the crust is typically too thick for an esthetically pleasing texture and the interior is overly dried and toughened. The problem is compounded when the waffle is accompanied by a side dish such as a meat product typically requiring a different heating schedule with a greater energy demand.

Much effort has gone into overcoming problems created by the special characteristics of common microwave ovens. One approach is found in U.S. Pat. No. 4,656,325, to Keefer. This patent discloses a package containing an article of foodstuff capable of being heated in a microwave oven, comprising a foodstuff holding pan and a nonreflecting energy cover having a dielectric constant greater than 10 and spaced from the top surface of the foodstuff about 0.8 to 2 cm. The dielectric constant and the spacing of the cover permit the passage of microwave energy through the cover into the package, while interfering with reflected microwave energy within the package. Thus the microwave energy is retained and concentrated within the package. Surface browning of the food occurs by field intensification at the food surface.

U.S. Pat. No. 4,190,757, to Turpin et al., discloses a food heating package formed from a microwave transparent nonlossy dielectric material and a lossy microwave absorptive sheet connected to the package and associated in heat conductive relationship with the food. The sheet thickness and the temperature response during microwave heating are positively correlated, and the sheet is of the minimum thickness that will reach but not exceed a preselected equilibrium operating temperature. The sheet is usually bonded to a structural supporting sheet, such as aluminum foil. The package also has a shield, which may have holes, in order to provide a predetermined controlled amount of direct microwave energy to the food. The absorber heats the food to a sufficiently high temperature to provide searing or browning.

U.S. Pat. No. 4,230,924, to Brastad, discloses a package containing an article of food to be heated in a microwave oven. The package comprises a flexible dielectric material conforming generally to the shape of the food, and individual electrically resistive islands, or pads, separated by crisscrossing nonmetallic gaps, carried by said dielectric material The islands convert some of the microwave oven energy to heat, modifying the color or crispness of the food adjacent thereto.

U.S. Pat. No. 4,676,857, to Scharr, discloses a microwave heating material and method for its preparation. A preselected metallized pattern, such as dots, spirals, or circles, is disposed on at least a portion of a dielectric material using a transfer process, in any variety of patterns. Patterned cooking could be provided by the use of trays having metallized patterns which would heat and brown slower cooking foods at the same rate of speed as other faster cooking foods.

U.S. Pat. No. 4,626,641, to Brown, discloses a carton for protection of a food product during shipment and for use in heating, crisping and browning the food. The carton includes a top panel having crisping means separated by a vertical distance of less than 2.7 cm from the top surface of the food product. The crisping means may be a metallized polyester, laminated onto the top panel. The food particularly disclosed is a pot pie.

U.S. Pat. No. 3,983,256, to Norris et al., discloses that pancakes or other farinaceous griddle foods coated with sugar syrup containing an edible emulsified fat heat more readily and evenly in a microwave oven than do uncoated farinaceous griddle foods.

SUMMARY OF THE INVENTION

This invention provides a package for cooking a waffle in a microwave oven comprising:

(a) a chamber in which the waffle lies, said chamber having sides and a bottom formed from a rigid or semi-rigid microwave transparent material, said chamber having a depth of from about 28 mm to about 38 mm;

(b) a susceptor film lid having a microwave reflectance of from about 0.4 to about 2.2% and a microwave absorbance sufficient to raise the temperature of the lid to about 100° C. in about 20 seconds and to from about 160° C.–200° C. in about 120 seconds when the oven is operating, said lid being positioned as the top of at least the portion of the chamber where the waffle lies and placed from about 3 mm to about 10 mm above the top surface of said waffle; and (c) a waffle having its top and bottom surfaces coated with an edible food conditioner to provide microwave susceptibility, said waffle having a thickness of from about 20.6 mm to about 36.6 mm.

DETAILED DESCRIPTION OF THE INVENTION

Figure 1:
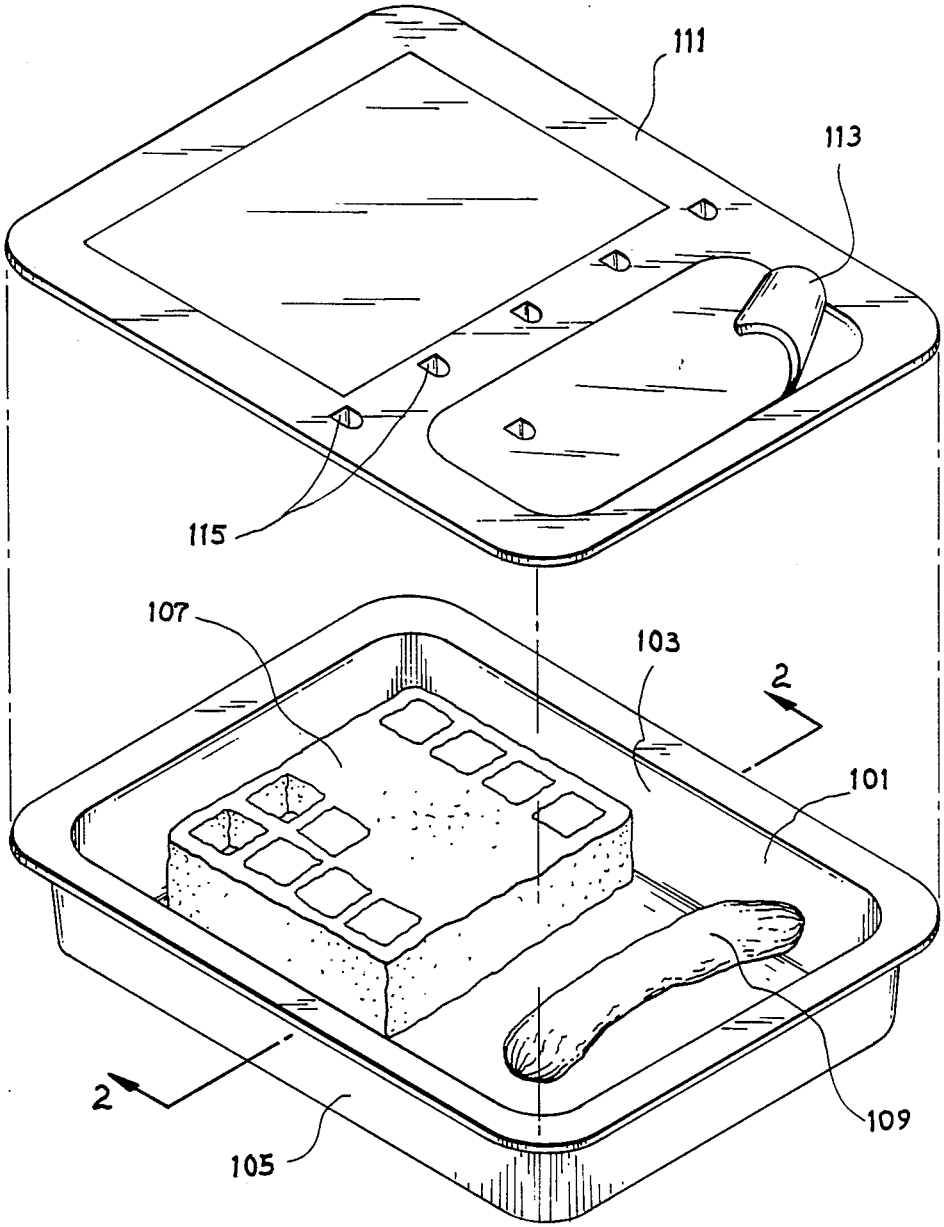
FIG. 1 is an isometric view of a food package according to the invention, showing a tray with waffle and sausage contents.

The invention comprises a disposable package and method for cooking in a microwave oven a frozen or unfrozen waffle, optionally along with a side dish, so that both are suitably cooked, browned, and crisped over the same time period.

A waffle, which is approximately 100 mm square by 25 mm thick (4×4×1 inches) and has been partially cooked prior to packaging, sufficiently to establish its shape and interior texture, is placed within the package. Both the top and bottom surfaces of the waffle are coated with an edible conditioner to enhance its appearance, flavor, and crisping, or become coated during the process of microwave cooking. This conditioner typically contains sweet syrups such as corn syrup or equivalent materials known to the trade. It usually comprises a flavor enhancing oil in the form of salted butter or one of its substitutes. Lastly, the conditioner may contain other color or flavor enhancing materials such as caramel and spices. The exact consistency is primarily dependent upon taste. However, to obtain enhanced browning and crisping, it is important that the conditioner contain materials, preferably salted butter, with some susceptibility to microwave energy, and particularly to the magnetic component of the microwave energy. It has been found that a generous amount of butter spread over both sides of the 100 mm square waffle is adequate for this purpose. However, it is preferred to incorporate the edible, microwave susceptible food conditioner into the batter and hence into the waffle. The conditioner migrates to the surface of the waffle, both during precooking of the waffle in the waffle iron and during cooking in the microwave oven. About 10% by weight of salted butter may be incorporated in the batter. In addition, about 8% sugar, and a modest amount of salt may be used. The surfaces of the waffle iron used for precooking of the waffle may be conditioned with a spray of partially hydrogenated vegetable oil, such as "PAM" TM, available from Boyle Midway Inc., New York, N.Y. 10017. Some modest amounts of this oil may also transfer to the waffle surfaces.

The food item or items to be cooked are contained in a microwave transparent tray, or chamber. The tray may be prepared from any convenient material, such as paperboard stock coated with a copolyester layer. The material should preferably be thin and lightweight, yet should have sufficient rigidity to maintain its shape.

The tray and food items are covered with a film lid, located above the waffle and across the top of the tray or chamber, at a spacing which will be described below. The film lid has two major requirements. First, it must be a lossy material, and reach a temperature of about 100° C. within 20 seconds and from about 160° C. to about 200° C. within two minutes when subjected to microwave energy having an electric field intensity of 242 V/cm rms, which is a typical field strength encountered in an oven cavity operated at full power (700 watts). A procedure for determining such heating properties is disclosed in U.S. patent application Ser. No. 002,980, filed on Jan. 23, 1987, the disclosure of which is incorporated herein by reference. Suitable films may reach 150° C. in as little as 30 seconds, but should reach 150° C. within about a minute if they are to perform properly. This degree of heating is generally achieved by providing a microwave absorptivity of the lid at 2450 MHz in the range of 0.5 to 10, and preferably in the range of 0.5 to 6%, as measured in a coaxial transverse electromagnetic (TEM) test cell which emulates free space conditions. The above described temperature rise aids in browning and crisping the top surface of the waffle. The hot film lid also helps prevent condensation of moisture which evolves from the food during heating. Such moisture would otherwise result in a soggy or unappealing surface on the waffle.

Secondly, the lid must further attenuate the incident microwave energy by reflection, in order to moderate interior cooking as the top and bottom waffle surfaces are being crispened. We have found that for the desired cooking action, the reflectance of the film as measured in a coaxial TEM cell approximating free space conditions should be in the range of 0.4–2.2%. The specific amount of reflected energy will be related to the specific cooking conditions—for films with higher reflectance, longer cooking times will generally be required, and vice versa.

The free space reflectivity of the lossy film, measured as described above, is, of course, only one factor in the total reflectance of the actual package of tray, foodstuffs, and lid. In the real instance, each interface provides a reflection, and, additionally, there are complex reflections from the oven sides, bottom, etc.

The lid thus provides a controlled balance between the amount of the impinging microwave energy which is reflected back from the surface of the sheet, the amount absorbed by the lid, and the amount which is transmitted into the foodstuff.

Suitable materials for use in constructing the film lid include those described in commonly assigned, copending U.S patent application Ser. No. 002,980, discussed above. That application discloses a composite material for controlled generation of heat by absorption of microwave energy, comprising (a) a dielectric substrate substantially transparent to microwave radiation, and (b) a coating on at least one surface of the substrate, comprising (i) about 5 to 80% by weight of metal or metal alloy susceptor in flake form, and (ii) about 95 to 20% by weight of a thermoplastic dielectric matrix, wherein the surface weight of the coating on the substrate is from about 2.5 to 100 g/m$^2$. Preferably the thermoplastic dielectric matrix comprises a polyester copolymer selected from the group consisting of copolymers of ethylene glycol, terephthalic acid and azelaic acid; copolymers of ethylene glycol, terephthalic acid, and isophthalic acid; or mixtures of said copolymers. Suitable susceptor flake materials include aluminum, nickel, antimony, copper, molybdenum, iron, chromium, tin, zinc, silver, gold, and various alloys of these metals. Preferably the susceptor flake material is aluminum. The flakes of the susceptor should have an aspect ratio of at least about 10, and will preferably have a diameter of about 1 to about 48 micrometers, and a thickness of about 0.1 to about 0.5 micrometers. In order to obtain uniformity in heating, it is preferred that the flakes be approximately circular, having an ellipticity in the range of about 1:1 to 1:2. Alternatively, the flakes, if not circular, can be applied to the film in two or more separate passes, which also provides an improvement in the degree of uniformity in heating. Films prepared from such material will typically have a surface resistance of at least $1\times10^6$ ohms per square.

The geometrical spacing of the lid over the waffle is important. In the package of the instant invention, the lid is spaced about ¼ free space wavelength (30.5 mm at 2450 MHz) above the bottom of the tray and, secondly, from about 3 to about 10 mm above the top of the waffle component. The lid must be close enough to the upper waffle surface so that the heat generated within the lid material as a result of its microwave absorption can be readily transferred by radiation or convection to the upper surface of the waffle. At the same time, the lid should not touch the waffle surface and should provide sufficient clearance so that moisture evolved from the waffle during cooking can escape and not be trapped, causing sogginess. The waffle thickness and the tray depth should be arranged to maintain this spacing in the range of about 3 to 10 mm, preferably about 3 to 9 mm, and most preferably about 6 mm. In order to facilitate the escape of the moisture evolved from the waffle, the package should contain vents. These vents may be in the form of open lid ends, holes, or cutout portions in the covering film, or holes or notches in the tray portion of the package, or equivalent means.

Needless to say, there is a great deal of variability in the composition of waffles, and a corresponding variability in their susceptibility to microwave cooking and browning. Individual waffles of nominally identical composition, for example, may vary by as much as plus or minus 7% in their moisture content. Such variation makes fine tuning of the characteristics of the lid and the package geometry important for optimum cooking of a waffle of a particular composition. Such adjustments are well within the abilities of the person skilled in the art.

The package of this invention can prepare a waffle with or without the inclusion of a side dish such as a sausage. In the package of the invention, the lid is positioned over at least the portion of the container where the waffle is placed. If the only food in the container is the waffle, the lid can extend over the entire top of the container, with proper venting. If the container also contains a sausage, the lid covers the waffle only. Some small corrections to exposure time may be required for heating a waffle in the presence of a side dish, compared with heating the waffle alone, as a result of the change in total loading. However, it is well within the capabilities of one skilled in the art to make such changes.

Referring now to FIG. 1, one embodiment of the present invention consists of a tray 101 with floor 103, and sides 105, which are pressed from a low cost, microwave transparent dielectric material. In this tray are placed a waffle 107 and a sausage 109. A lid 111, formed from a susceptor film, is placed over the top of the tray and its contents. The lid 111 is equipped with a removable window 113 in the area above the sausage, to provide transparency above the sausage and venting for the entire package. Vents 115 may be provided in order to permit water vapor to escape from the package during cooking. Such vents are desirable if there is no other means for the water vapor to escape from the package.

Figure 2:
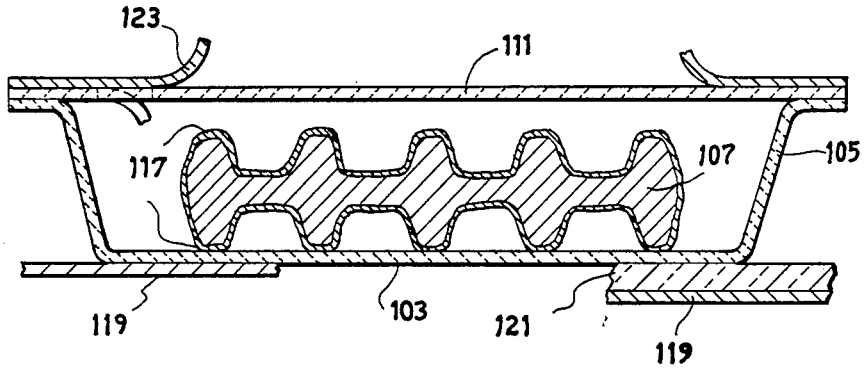
FIG. 2 is an elevational cross section of a food package according to the invention.

FIG. 2 shows a detailed sectional view taken along line 2—2, through the waffle 107. In this figure the edible conditioner 117 is shown as applied to the upper and lower surfaces of the waffle. The package can rest directly on a metallic bottom 119 of the oven cavity, or on a glass tray 121, which is common in many microwave ovens. Alternatively, it can be placed on a metallic or partly metallic carousel or other metallic surface (not shown). An optional cover 123 can be used for shipping and sealing purposes. Cover 123 is removable by the user before microwaving, and typically will be a peelable plastic or paper sheet imprinted with advertising or microwaving instructions.

Figure 3:
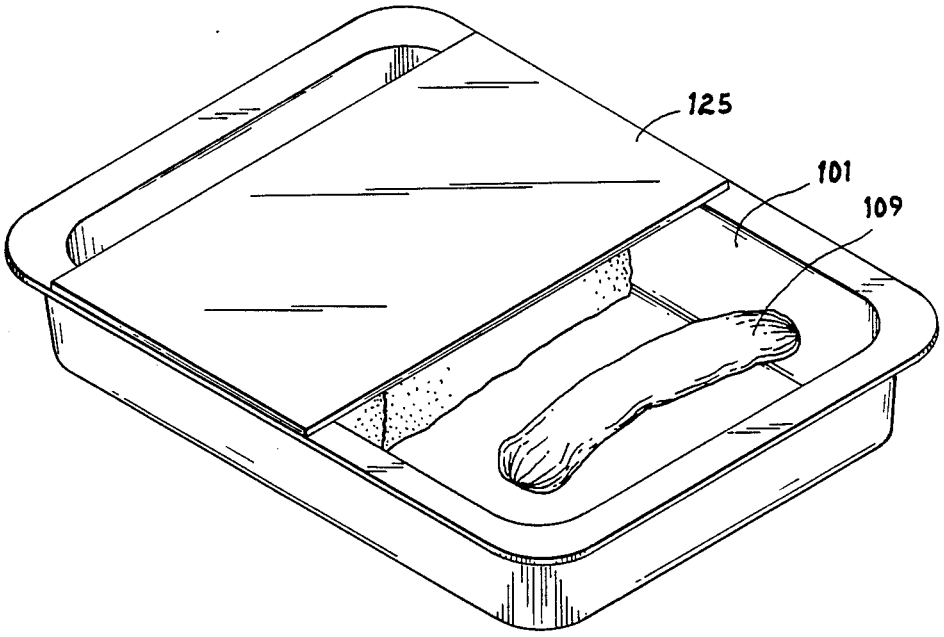
FIG. 3 is an isometric view of another embodiment of the invention, showing a tray with waffle and sausage contents.

FIG. 3 shows another embodiment of a package of this invention. In this view, a strip of film 125 containing the susceptor material is positioned only over the waffle, and the sausage is uncovered. Water vapor can thus escape through the uncovered area over the sausage.

The importance of spacing the lid about ¼ freespace wavelength above the bottom of the tray is not clearly understood, due to the various numerous and complex interactions among the microwave energy modes, the package and the foodstuffs. Although the invention is not bound by any particular theory of operation, it is believed that several factors are important to obtain the benefits of the invention.

The small amount of microwave energy reflected from the susceptor material of the lid combines constructively with reflections from the vicinity of the package bottom, thus increasing the impedance mismatch between the oven cavity and the interior of the package. Although the spacing between the cover and the tray bottom is about one quarter wavelength of the microwaves travelling in free space, the actual electrical path length is longer because of the dielectric properties of the waffle or other foodstuff. The result is that less power is transmitted into the waffle than would occur without the susceptor lid in place. The foregoing interaction slows the rate of cooking of the interior of the waffle, effectively providing a moist and soft waffle interior while the top and bottom surfaces of the waffle are being crispened, and while the side dish, if present, is being cooked. This effect has been partially confirmed by measurements of the reflected energy from the package. The packages which gave successful cooking of the waffle showed a higher amount of reflected energy than in cases where the lid was omitted.

Positioning the lid at ½ free space wavelength above the bottom of the oven can also give good results, provided that the distance between the lid and the top of the waffle is kept within the above specified distance, and a ground plane is established at the bottom of the package. If the susceptor lid alone is placed at the ½ wavelength position and the remainder of the package remains at the ground plane, a relatively good waffle may be prepared, with somewhat less top browning than desired because of the extended gap. However, the ¼ wavelength spacing is more convenient, providing a more compact and effective package.

The invention also provides a process for cooking a waffle, optionally with a side dish, in a microwave oven, using the package described above The package is placed in the oven and the oven is operated for a sufficient time to heat the interior of the waffle to the desired consistency, while browning and crisping the upper and lower surfaces of the waffle.

The invention also provides a process for preparing a waffle contained in a disposable microwave cooking package having a microwave transparent tray and an electrically lossy film susceptor lid. The process includes preparing a precooked waffle with an edible food conditioner applied to its top and bottom surfaces, in order to provide microwave susceptibility to the magnetic field component of microwave radiation, said waffle having a thickness of about 20.6 to about 36.6 mm. The waffle is placed in the tray, a lid, as described above, is placed on the tray at a distance of about 3 to about 10 mm above the surface of the waffle, and the waffle is frozen in the tray.

The invention is further illustrated by the following examples, in which temperatures are in degrees Celsius, and percentages are by weight unless otherwise indicated.

EXAMPLES

Example 1

The lid material was a laminate including a layer of 30# bleached kraft paper stock and a layer of 0.023 mm (92 gauge) Mylar® polyester film obtainable from E. I. du Pont de Nemours and Company, Inc., Wilmington, Del., 19898.

The lid material further included a resinous coating layer containing dispersed susceptor material. The coating matrix was prepared by combining 15.8 parts by weight of the copolymer condensation product of 1.0 moles ethylene glycol with 0.53 moles terephthalic acid and 0.47 moles azelaic acid, with 0.5 parts by weight of erucamide and 58 parts by weight of tetrahydrofuran. This mixture was placed in a heated glass reactor vessel equipped with a paddle stirrer. After dissolving the solids at 55°, 0.5 parts by weight of magnesium silicate and 25 parts by weight of toluene were blended in. Three thousand grams of this solution were mixed with 640 g of aluminum paste (70% aluminum solids in mineral spirits), commercially available as "Sparkel Silver TM," type 3641, from Silberline Manufacturing Company.

The coating solution was dispersed, using two passes, on a 280 mm wide doctor roll coater to obtain, after drying, a coating thickness of approximately 0.03 mm (1 mil). The total dry coating weight was approximately 30 g/m$^2$. Due to losses and retained mineral spirits, the final concentration of aluminum on the film was 11 g/m$^2$.

A sample of the lid material was measured in a coaxial TEM cell, model SET-19, from ELGAL Industries, Ltd., Israel, which was excited by 2.4 to 2.5 GHz signals from a Hewlett Packard HP8620C Sweep Oscillator. A Hewlett Packard HP8755C scalar network analyzer was used to obtain the scattering matrix parameters of the sample under test. This cell provides a transverse electromagnetic wave closely simulating free space microwave propagation conditions. These conditions are referred to as "SET," meaning "simulated electromagnetic test." Under the SET conditions, the sheet exhibited a microwave transmission at 2450 MHz of 95.2%, absorption of 4.3%, and reflection of 0.5%.

A sample of the lid material was also exposed to microwave power in a laboratory waveguide field measurement with an electric field intensity of 242 V/cm rms, which is a typical field strength encountered in an oven cavity operated at full power (700 watts). Under these conditions, the film reached an average temperature of 150° within one minute. A detailed description of this test is disclosed in U.S. patent application Ser. No. 002,980, discussed earlier herein.

A paper based tray was used as the container with dimensions 15.5 by 11.4 cm (not including a lip extending out on all sides by a distance of 8 mm) at the top; 12.4 by 8.9 cm with radiused corners at the bottom; and 3.5 cm deep. The tray wall and bottom thicknesses were about 0.5 mm, with the tray bottom convoluted to raise the waffle about 1 mm above the tray's resting surface.

A Belgian waffle measuring about 100 mm square by 25 mm thick was lightly precooked from batter sufficient to fully form its shape and internal structure. The batter contained flour, milk, egg, vanilla, starch, baking soda, and salt, with in excess of 7% by weight of sugar and in excess of 10% by weight of salted butter. This batter had a moisture content of about 36% by weight. After precooking, the waffle was frozen. A single link of precooked and prebrowned sausage approximately 20 mm diameter by 90 mm long was obtained frozen from a local food store. The waffle was placed in the tray near one end, and the sausage link was placed at the other end, to form a composite breakfast platter as might be commercially distributed for the microwave convenience food market.

A 100 mm wide strip of the lidding material was placed across the top of the tray containing the waffle and sausage. It was positioned so the lid material was directly over the waffle while the remainder of the tray cavity was left open. The tray was then placed on the floor of a 600W Amana oven and exposed to microwave energy. The cooking was done for a 2.0 minute period using a "high" (full power) setting. After completion of the cycle the foodstuffs were examined and tasted. The sausages were adequately heated and tasty. The surfaces of the waffle, both top and bottom, were well browned and crisp, and not soggy. It was observed that the interior of the waffle was warm, tender, nontoughened, and exhibited a good, slightly chewy texture.

Comparative Example 1

The experiment of example 1 was repeated with the lidding material left off. Under these circumstances, waffle preparation was not satisfactory. At a 2.5 minute exposure, the top surface was still not browned and crisped. When the exposure was increased to that sufficient to achieve browning, the interior of the waffle was hard and tough and the sausage was overcooked.

Comparative Example 2

The experiment of example 1 was repeated except that the entire package was raised above the floor of the oven by the thickness of one package (i.e., about $\frac{1}{4}$ wavelength), where a magnetic null for the predominant mode would be expected. The waffle cooked poorly and was soggy.

Example 2

A package similar to that of Comparative Example 2 was heated in an oven, in the same location as in Comparative Example 2, except that an aluminum sheet was inserted immediately beneath the package, providing a ground plane. The desirable cooking results of Example 1 were reestablished.

Examples 3–9 and Comparative Example 3

Table I shows the results when different lid materials were used in cooking a waffle similar to that described in Example 1. A sausage was also present in the packages of these examples. Cooking was done in a 700 watt Sharp Carousel II TM microwave oven at full power for two minutes. It can be seen that cookability is a function of both temperature of the film lid, and cooking time. Examples 3, 4, and 5 illustrate that the cooking time must be correctly selected in order to achieve best results, even when the film properties are optimum.

Compositions and heating properties of the lid materials used in these examples are described in Table II. The abbreviations used in Table II are defined as follows:

adhes: adhesive, "Adcote 333," from Morton Chemical Div. of Morton Thiokol, Inc., Chicago, Ill.

copoly: copolymer condensation product described in Example 1, coated on a film of polyethylene terephthalate.

flake1: coating, prepared as in example 1, containing aluminum flake from Reynolds (L5B-548), flake2: coating, prepared as in Example 1, containing the same aluminum flake as in Example 1.

paper1: 30# bleached kraft paper.

paper2: 48# bleached kraft paper.

polyest: polyethylene terephthalate film ("Mylar TM").

It is apparent by comparing the result from Table I with the film heating properties of Table II, that when a film is used which reaches a higher temperature, a shorter cooking time is appropriate, and vice versa.

Examples 10–24

Table III shows the results of experiments in which the geometry of the lid, tray, and waffle were varied, using in each case a flake susceptor film lid, tray system, and contents as in Example 1, except as noted. The cooking conditions were the same as for examples 3–9, except as noted. For certain of the packages described in the examples of Table III, independent measurements were made of the total reflectance, $R^2$, form the total package, including the tray, film, and waffle (without sausage). (For examples 21 and 23–25, reflectance measurements were made, but waffles were not actually cooked in the corresponding configurations.) To approximate conditions in a real microwave oven for this measurement, an open topped aluminum box was constructed, the size and shape of a typical microwave oven, with 0.6 mm thick walls and dimensions of 305 mm×305 mm×298 mm. A tray containing waffle and sausage with susceptor lid was placed into the box, and the assembly irradiated with 2450 MHz microwave energy of 5 to 30 milliwatts introduced at the top of the box via an omnidirectional conical antenna (Singer Company, Los Angeles, Calif., part no. 90794-2). The cone antenna was centered in the aluminum box with the elevation between the bottom of the cone antenna and the inner bottom surface of the box being 191 mm. The top of the box was sealed with aluminum duct tape to avoid perturbation of the measurement by external factors. Instrumentation to measure reflectance, both in amplitude and phase, was provided by an HP8510 network analyzer from Hewlett Packard.

It can be seen that quality of cooking is a complex function of film, waffle size, and tray geometry, showing evidence of periodicity as the lid and waffle are moved about in the microwave field. The results also show that the total package reflectance varies as a function of the distance of the tray from the bottom of the oven, a maximum reflectance being obtained when the package rests directly on the oven floor. It is in this position that the cover film is located approximately ¼ free space wavelength above the ground plane, and it is in this position, furthermore, that the optimum cooking occurs.

TABLE I

| Ex. | Lid | Time | Effect on Waffle: Top | Bottom | Inside |
|---|---|---|---|---|---|
| 3 | a | 2 | soggy | soggy | undercooked |
| 4 | a | 2.5 | crispy | crispy | slightly tough |
| 5 | a | 3 | tough | tough | overcooked |
| 6 | b | 2 | crispy | crispy | chewy, good |

TABLE I-continued

| Ex. | Lid | Time | Effect on Waffle: Top | Bottom | Inside |
|---|---|---|---|---|---|
| 7 | c | 2 | slightly soft | OK | slightly tough OK |
| 8 | d | 2 | mushy | not done, little tough | chewy, OK |
| 9 | e | 2 | mushy | little mushy | little tough |
| C3 | none | 2 | overcooked throughout, oil released | | |

1. Lid films are described in Table II. Time is cooking time, in minutes.

TABLE II

| Film | Structure of film layers, Layer composition/width, mm: 1 | 2 | 3 | 4 | 5 | 6 |
|---|---|---|---|---|---|---|
| a | paper 1 152 | adhes 152 | copoly 152 | adhes 102 | paper 2 102 | flake 1 102 |
| b | paper 1 152 | adhes 152 | copoly 152 | adhes 102 | polyest 102 | flake 2 102 |
| c | paper 1 152 | adhes 152 | copoly 152 | adhes 102 | polyest 102 | flake 2 102 |
| d | paper 1 152 | adhes 152 | copoly 152 | adhes 102 | polyest 102 | flake 1 102 |
| | (film d contained perforations) | | | | | |
| e | paper 1 152 | flake 2 152 | adhes 152 | copoly 152 | | |
| f | paper 1 152 | adhes 152 | copoly 152 | adhes 102 | polyest 102 | flake 2 102 |
| g | copoly 152 | adhes 102 | flake 2 102 | copoly 102 | | |

| Film | Coating, g/m² Al flake | total[2] | Film Temp.[1] MD | TD | % Refl | % Trans | % Abs |
|---|---|---|---|---|---|---|---|
| a | — | 10 | 182 | 175 | 2 | 92 | 6 |
| b | 11.2 | 30 | 195 | 184 | 1 | 95 | 4 |
| c | 7.6 | 21 | 167 | 173 | 1 | 97 | 2 |
| d | — | 14 | 181 | 159 | 1 | 95 | 4 |
| e | — | 22 | — | — | 0 | 96 | 4 |
| f | 7.6 | 23 | 154 | 146 | 1.6 | 97.7 | 0.7 |
| g | 14.7 | 32 | 195 | 200 | 1.6[3] | 90[3] | 8[3] |

[1]Equilibrium temperature (4 min.) measured in waveguide with film oriented machine or transverse direction, respectively, parallel to electric field.
[2]Total of Al flake plus matrix resin.
[3]Estimated.

TABLE III

| Ex. | Waffle size (mm) Edges | Thickness | Gap distance (mm) film-waffle | tray-floor | Reflect. Power $R^2$ |
|---|---|---|---|---|---|
| 10 | 97 × 92 | 25 | 6.3 | 0 | — |
| 11 | " | " | 6.3 | 32 | — |
| 12 | " | " | 6.3 | 0 | — |
| 13 | " | " | 38.1 | 0 | — |
| 14 | " | " | 6.3 | 19 | — |
| 15 | " | " | 6.3 | 6.3 | — |
| 16 | " | " | 6.3 | 13 | — |
| 17 | " | " | 9.5 | 0 | 0.165 |
| 18 | " | " | 9.5 | 3.2 | 0.045 |
| 19 | " | " | 9.5 | 6.3 | 0.055 |
| 20 | " | " | 9.5 | 9.5 | 0.051 |
| 21 | " | " | 9.5 | 13 | 0.129 |
| 22 | " | " | 44.4 | 0 | 0.158 |
| 23 | 83 × 86 | 25 | 9.5 | 0 | 0.018 |
| 24 | 76 × 76 | 25 | 9.5 | 0 | 0.006 |
| 25[1] | " | 25 | 9.5 | 0 | 0.007 |

| Ex. | Film | Cook Time, min. | Comment on Waffle: Top | Bottom | Interior |
|---|---|---|---|---|---|
| 10 | f | 2 ¼ | golden brown | soggy | OK |
| 11 | f | 2 ¼ | soggy | soggy | soggy |
| 12 | f | 2 ¼ | crisp | soggy | OK |
| 13 | f | 2 ¼ | somewhat crisp | soggy | somewhat soggy |
| 14 | f | 2 ¼ | somewhat crisp | somewhat soggy | OK |
| 15 | f | 2 ¼ | crisp | somewhat | OK |

TABLE III-continued

| | | | | | |
|---|---|---|---|---|---|
| 16 | f | 2 ¼ | crisp | soggy somewhat soggy | OK |
| 17 | g | 2 | crisp | crisp | chewy, good |
| 18 | g | 2 | — | — | tough |
| 19 | g | 2 | — | — | tough |
| 20 | g | 2 | — | — | tough |
| 21 | g | — | — | — | — |
| 22 | g | 2 | slightly crisp | crisp | moist, chewy |
| 23 | g | — | — | — | — |
| 24 | g | — | — | — | — |
| 25[1] | g | — | — | — | — |

[1]Same as Ex. 24, but package moved away from center of oven.

The invention being claimed is:

1. A package for cooking a waffle in a microwave oven, said waffle having a thickness of from about 20.6 to about 36.6 mm and having its top and bottom surfaces coated with an edible food conditioner to provide microwave susceptibility, said package comprising:

(a) a chamber in which the waffle lies, said chamber having sides and a bottom formed from a rigid or semirigid microwave transparent material, said chamber having a depth of from about 28 mm to about 38 mm; and (b) a susceptor film lid having a microwave reflectance of from about 0.4 to about 2.2% and a microwave absorbance sufficient to raise the temperature of the lid to about 100° C. within about 20 seconds and to from about 160°-200° C. within about 120 seconds when the oven is operating, said lid being positioned as the top of at least the portion of the chamber where the waffle lies and placed about 3 mm to about 10 mm above the top surface of said waffle.

2. A package according to claim 1 having means for venting of moisture during the microwave cooking cycle.

3. A package according to claim 2 wherein the lid is formed from a microwave transparent substrate which is coated with aluminum flake in a resinous matrix.

4. A package according to claim 3 wherein the microwave transparent substrate from which the lid is formed is paper, resinous plastic or a combination of both.

5. A package according to claim 4 wherein the lid is formed from a composite material comprising a dielectric substrate and a coating on at least one surface of the substrate comprising (i) about 5 to about 80% by weight of aluminum flake and (ii) from about 95% to about 20% by weight of a thermoplastic dielectric matrix, wherein the surface weight of said coating on the substrate is from about 2.5 to 100 g/m$^2$.

6. A package according to claim 5 wherein the lid is placed about 3 mm to about 6 mm above the top surface of the waffle and wherein the aluminum flakes have an aspect ratio of at least about 10, a diameter of about 1 to about 48 micrometers, and a thickness of about 0.1 to about 0.5 micrometers.

7. A package according to claim 6 wherein the aluminum flakes are substantially circular, having an ellipticity in the range of about 1:1 to 1:2.

8. A package according to claim 6 wherein the lid is formed from a composite material comprising a dielectric substrate and a coating on at least one surface of the substrate comprising (i) about 35% to about 40% by weight of aluminum flake and (ii) about 65% to about 60% by weight of a thermoplastic dielectric matrix, wherein the surface weight of said coating on the substrate is about 14.0 to about 30.0 g/m$^2$.

9. A package according to claim 8 wherein the dielectric substrate is a polyester copolymer selected from the group consisting of copolymers of ethylene glycol, terephthalic acid and azelaic acid, copolymers of ethylene glycol, terephthalic acid and isophthalic acid, and mixtures of said copolymers.

10. A package according to claim 9 having an additional cover sheet which is removed before microwaving and which serves to seal the package during storage and optionally bearing instructions or other printed information.

11. A package according to claim 6 having a meat product side dish and wherein the susceptor film lid is positioned solely above the waffle.

12. A package according to claim 11 wherein the meat product side dish is patty or link sausage.

13. A package according to claim 6 having a meat product side dish, a susceptor film lid positioned above the entire chamber, and the portion of the lid above the meat product side dish is removed prior to heating.

14. A package according to claim 13 wherein the meat product side dish is link or patty sausage.

15. A package for cooking a waffle in a microwave oven comprising:

(a) a chamber in which the waffle lies, said chamber having sides and a bottom formed from a rigid or semirigid microwave transparent material, said chamber having a depth of from about 28 mm to about 38 mm;

(b) a susceptor film lid having a microwave reflectance of from about 0.4 to about 2.2% and microwave absorbance sufficient to raise the temperature of the lid to about 100° C. within about 20 seconds and to from about 160°-200° C. within about 120 seconds when the oven is operating, said lid being positioned as the top of at least the portion of the chamber where the waffle lies and placed about 3 mm to about 10 mm above the top surface of said waffle; and (c) a waffle having its top and bottom surfaces coated with an edible food conditioner to provide microwave susceptibility, said waffle having a thickness of from about 20.6 mm to about 36.6 mm.

16. A method for preparing a waffle contained in a disposable microwave cooking package having a microwave transparent tray and an electrically lossy film susceptor lid, comprising (a) providing the top and bottom surfaces of a waffle with an edible food conditioner exhibiting microwave susceptibility to the magnetic field of microwave radiation, said waffle having a thickness of about 20.6 to about 36.6 mm (b) freezing the waffle in the tray; and (c) positioning the lid onto the tray to cover at least the waffle, said lid being placed at a spacing of from about 3 mm to about 10 mm above the top surface of the waffle, said lid comprising a laminate coating of aluminum flake particles on paper or polyester copolymer, and said lid having a microwave reflectance of from about 0.4 to about 2.2% and a microwave absorbance sufficient to raise the temperature of the lid to about 100° C. in about 20 seconds and to from about 160°-200° C. in about 120 seconds when the oven is operating.

* * * * *